US006489943B1

(12) United States Patent
Yeo

(10) Patent No.: US 6,489,943 B1
(45) **Date of Patent: *Dec. 3, 2002**

(54) DATA DRIVER FOR USE IN LIQUID CRYSTAL DISPLAY

(75) Inventor: Ju-Cheon Yeo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/487,663

(22) Filed: Jan. 19, 2000

Related U.S. Application Data

(63) Continuation of application No. 08/823,904, filed on Mar. 25, 1997, now Pat. No. 6,049,320.

(30) Foreign Application Priority Data

Jul. 27, 1996 (KR) ..... 96-30797

(51) Int. Cl.[7] ..... G09G 5/06
(52) U.S. Cl. ..... 345/99; 345/98; 345/100
(58) Field of Search ..... 345/99, 98, 100, 345/87, 90, 94, 208, 212

(56) References Cited

U.S. PATENT DOCUMENTS

| | | | | |
|---|---|---|---|---|
| 5,166,670 | A | 11/1992 | Takeda et al. | 340/784 |
| 5,266,936 | A | 11/1993 | Saitoh | 345/98 |
| 5,434,899 | A | 7/1995 | Huq et al. | 377/78 |
| 5,477,234 | A | 12/1995 | Suzuki et al. | 345/95 |
| 5,583,535 | A | 12/1996 | Takarada et al. | 345/99 |
| 5,796,379 | A | 8/1998 | Enomoto et al. | 345/89 |

*Primary Examiner*—Kent Chang
(74) *Attorney, Agent, or Firm*—Finnegan, Henderson, Farabow, Garrett, & Dunner, L.L.P.

(57) ABSTRACT

A ramp signal application type of data driver in a liquid crystal display. The data driver includes a plurality of shift registers and sample and hold circuits that sample data lines. A plurality of timing control parts receive the sampled data from the sample and hold circuits and n timing signals having different periods from each other to thereby perform a logical operation. A plurality of transistors receive a ramp signal and are switched in accordance with the signals output by the timing control parts to output the ramp signal based on when the transistor is on and off.

9 Claims, 8 Drawing Sheets

DATA DRIVER FOR USE IN LIQUID CRYSTAL DISPLAY

This is a continuation of application Ser. No. 08/823,904, filed Mar. 25, 1997, now U.S. Pat. No. 6,049,320 which is incorporated herein by reference.

BACKGROUND OF THE INVENTION

1. Field of the Invention

The present invention relate to a data driver for use in a liquid crystal display and, more particularly, to a ramp signal application type of data driver.

2. Description of the Related Art

FIG. 1 is a block diagram illustrating a construction of a conventional data driver. FIGS. 2A to 2C are timing diagrams illustrating output states at point. A, B and C of FIG. 1. Referring to FIG. 1, the conventional data driver includes a plurality of registers 1, a plurality of counters 2 and a plurality of pass transistors 3. Digital data is sequentially loaded into the plurality of registers 1. After the digital data is loaded into a register it is transferred to a corresponding counter 2.

When a load signal is applied to the lead line of each of the counters 2, the counters 2 each set a corresponding digital data count value and count down from the digital data count value according to an input clock signal. The counters 2 execute a logical ORing operation on signals output from a plurality of internal flip-flops, to thereby produce a pulse width modulated output. Output digital bits from the counters 2 are applied to corresponding pass transistors 3 for producing ramp signal for producing ramp signal lines.

When a load signal is applied to the lead line of each of the counters 2, the counters 2 each set a corresponding digital data count value and count down from the digital data count value according to an input clock signal. The counters 2 execute a logical Oring operation on signals output from a plurality of internal flip-flops, to thereby produce a pulse width modulated output. Output digital bits from the counters 2 are applied to corresponding pass transistors 3 for producing ramp signal lines.

When the output digital bits from the counters 2 become high, "H" level, the corresponding pass transistors 3 are turned on, and the ramp signals are applied to data lines.

On the other hand, when the output signals from the counters 2 become low, "L" level, the corresponding pass transistors 3 are turned off and the ramp voltage on the data lines is unchanged. The ramp voltage determines a brightness of picture elements in a liquid crystal display.

FIG. 2A is a timing diagram showing output waveforms of the applied ramp signal. FIG. 2B is a timing diagram showing output waveforms of a counter 2 in the case of digital data "000010" and "111101". FIG. 2C is a timing diagram showing output waveforms of a voltage or responding to a transformed ramp signal of FIG. 2A in response to digital data output of the counter 2 of FIG. 2B.

FIG. 3 is a circuit diagram of the counter 2 of FIG. 1. A load signal is inverted and applied to "OR" gate 300, digital data, data A–D, is supplied to each terminal of the counters 2 through "AND" gates 310. Next, the counters 2 are each set to a corresponding data count value of the applied digital data. After the data loading is completed, a clock signal is applied to flip-flops 312–318 in counter 2. The counters 2 respectively countdown by 1 from the digital data count value, and when the digital data value is "0000", the counter is reset and halted. Then, OR Gate 320 performs a logical OR operation on the flip-flop outputs $Q_A$, $Q_B$, $Q_C$ and $Q_D$. The counters 2 respectively output the OR-ed result as an output signal.

Accordingly, the conventional data driver for use in a liquid crystal display requires counters with complicated circuit construction.

SUMMARY OF THE INVENTION

Accordingly, the present invention is directed to a data driver for use in a liquid crystal display that has a simplified structure.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is provided a data driver in a liquid crystal display, the data driver including a plurality of data lines; a plurality of shift registers for sequentially outputting a sample control signal; a plurality of sample and hold circuits, connected to each of the data lines, for sampling data on corresponding data lines in response to the sample control signal; and a plurality of timing control parts for receiving sampled data from the sample and hold circuits and for performing a logical operation on the sample data.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
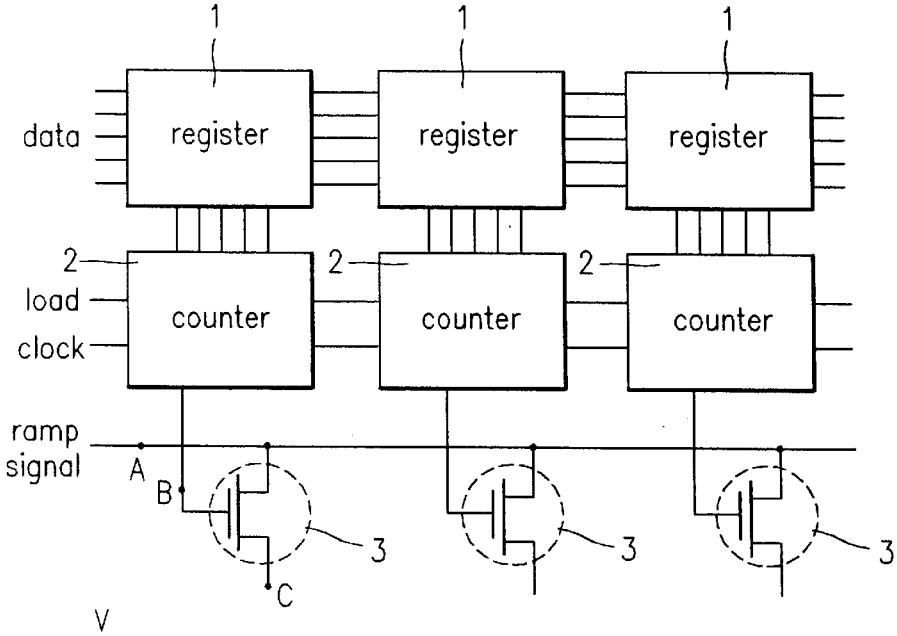
F I G.1 prior art
FIG. 1 is a block diagram illustrating a construction of a conventional data driver.
Figure 2A:
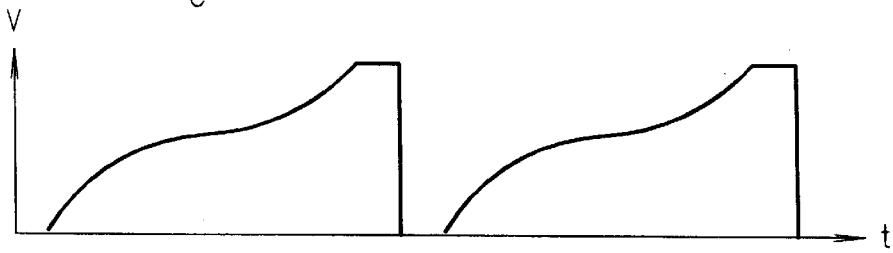
F I G.2A prior art
FIGS. 2A to 2C are timing diagrams illustrating the signals at points A, B and C of FIG. 1.
Figure 2B:
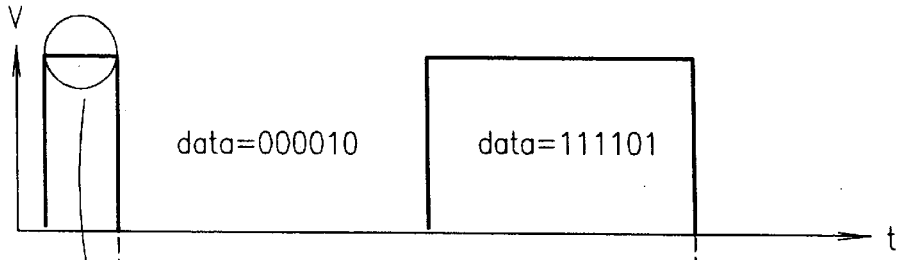
F I G.2B prior art
Figure 2C:
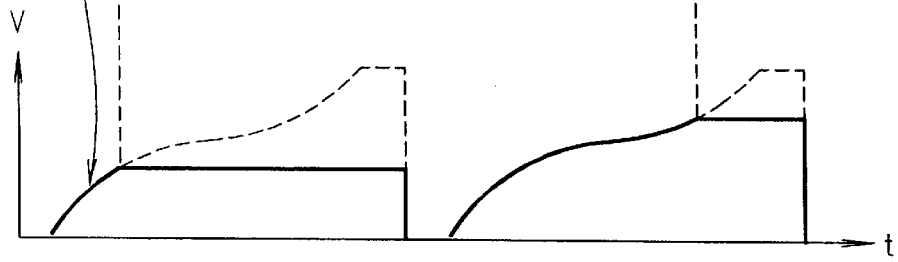
F I G.2C prior art
Figure 3:
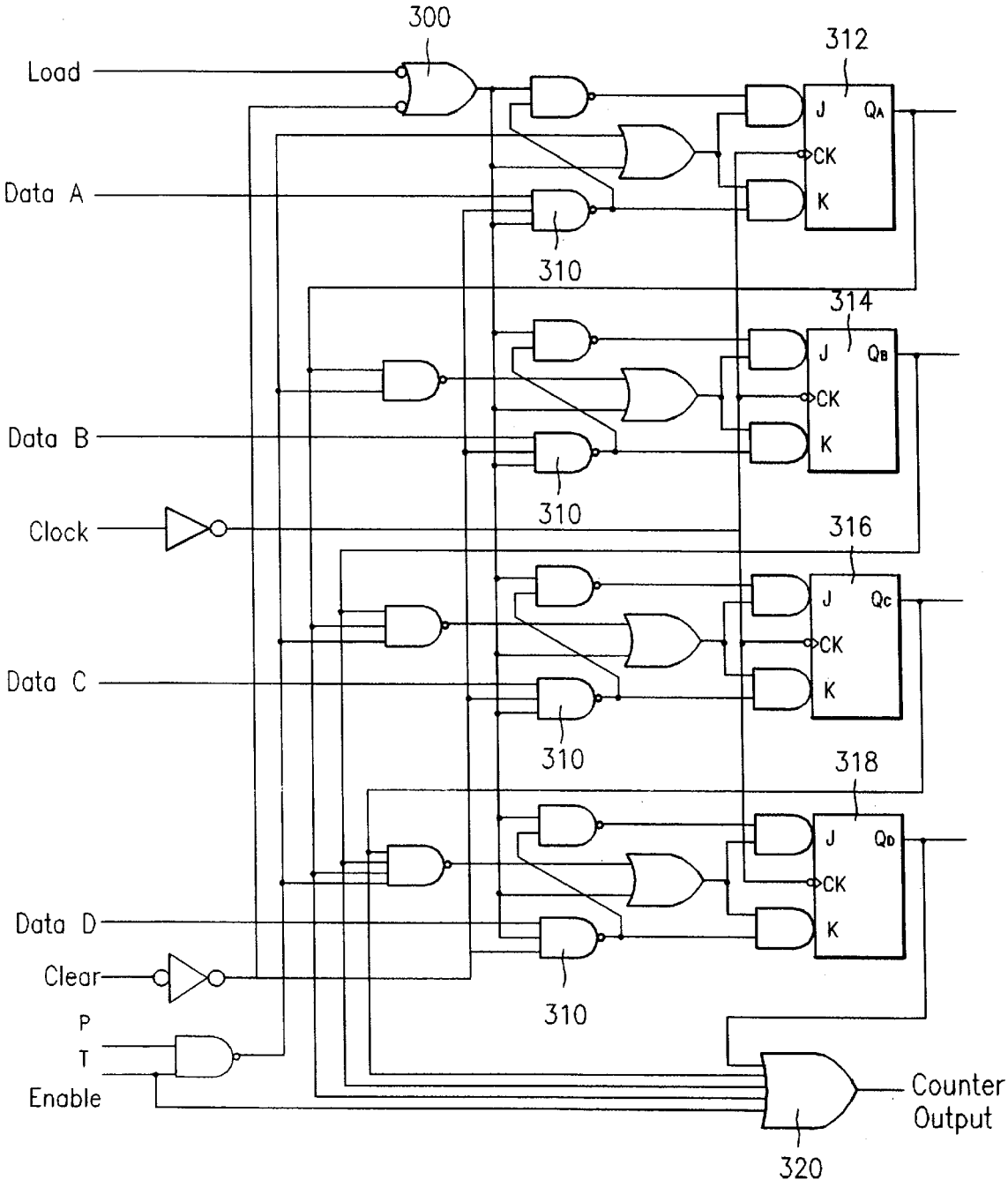
F I G.3 prior art
FIG. 3 is a circuit diagram of the counter included in a Shift register of FIG. 1.
Figure 4:
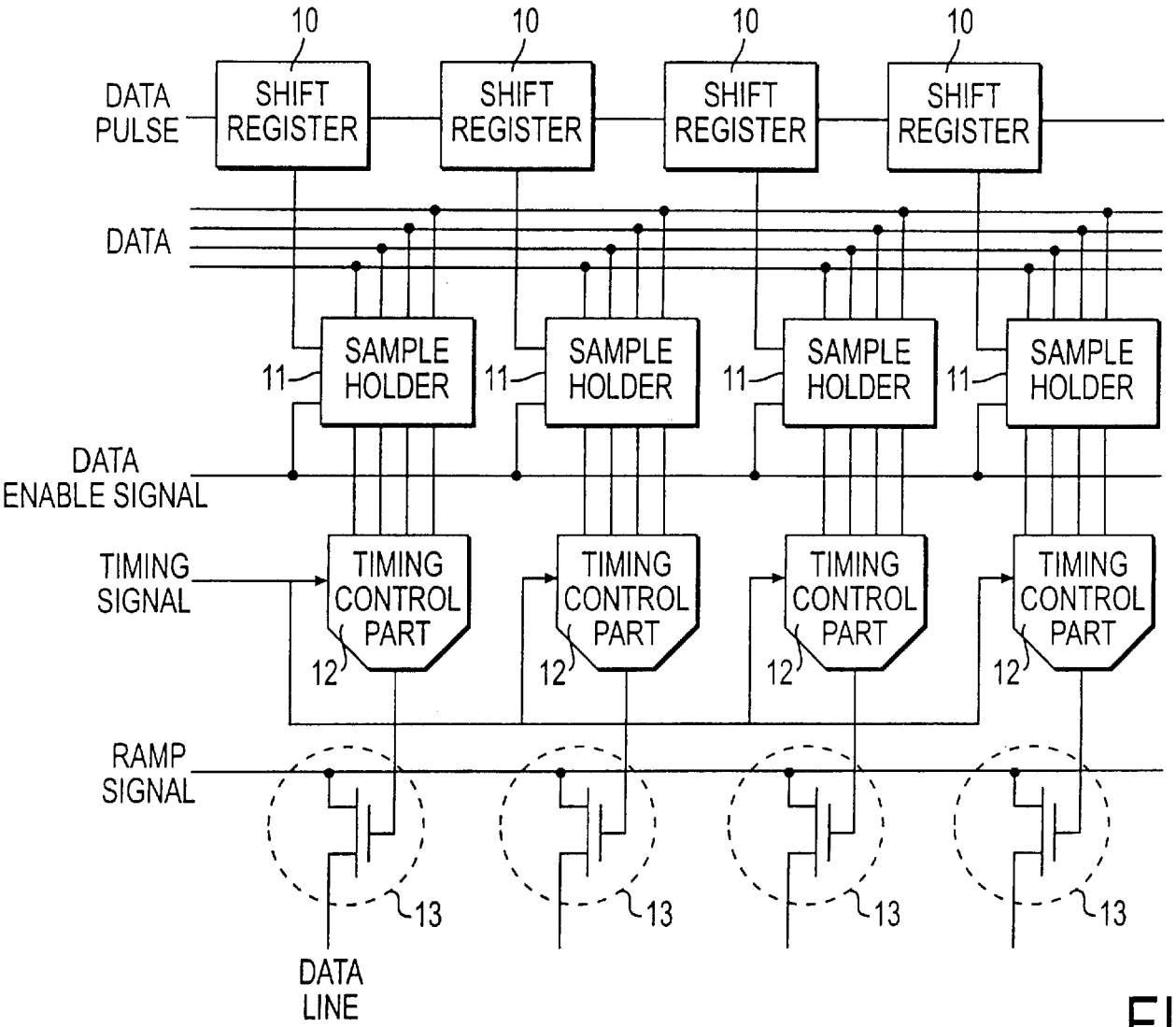
FIG. 4 is a block diagram of a data driver according to the present invention.

FIG. 4 is a block diagram illustrating a data driver for use in a liquid crystal display according to the present invention. The data driver includes a plurality of shift registers 10, a plurality of sample and hold circuits 11 preferably of a conventional type, a plurality of timing control parts 12 and a plurality of transistors 13. The plurality of shift registers 10 respectively output signals to sample and hold circuits 11 for sequentially sampling digital data from data lines. A corresponding image signal on each data line is stored in digital data format in the sample and hold circuits 11.

After the digital data is stored in the sample and hold circuits 11, a data enable signal is applied to each of the sample and hold circuits 11. simultaneously, the digital data stored in each of the sample and hold circuits 11 is applied to a corresponding timing control part 12.

Each of the timing control parts 12 receives the digital data and "n" timing signals, each having different periods from each other. The timing control parts 12 perform logical operations on the digital data and the timing signals to produce pulse width modulated (PWM) output signals to the pass transistors 13.

The pass transistors 13 are each connected to an external ramp signal line and receive respective PWM output signals from the timing control parts 12. When the output signals from the timing control parts 12 are low, at the "L" level, the corresponding pass transistors 13 are turned on, thereby blocking the ramp signal from transmitting to pixels in the liquid crystal display 4A and when the output signals are high, at the "H" level, the corresponding pass transistors 13 are turned off passing light to pixels in the liquid crystal device.

When the pass transistors are turned off, a ramp voltage is maintained on the data line connected to a picture element. The ramp voltage determines a brightness of the picture element in the liquid crystal display. The application of the ramp signal can be controlled by the PWM output signal from the timing control part 12.

Figure 5:
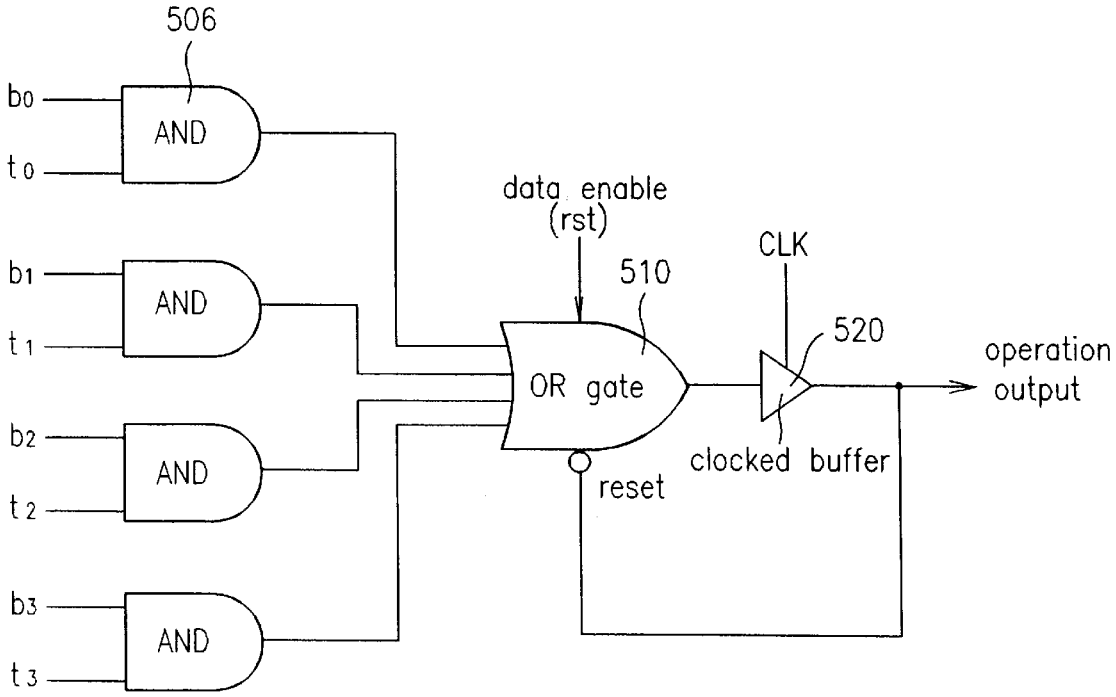
FIG. 5 is a circuit diagram illustrating a 4-bit logic circuit of a timing control part of FIG. 4.

FIG. 5 is a circuit diagram of a logic circuit in each timing control part 12 for handling bits of digital data of FIG. 4. FIGS. 6A to 6D are timing diagrams illustrating input/output waveforms to/from the timing control part logic circuit of FIG. 5.

Figure 6A:
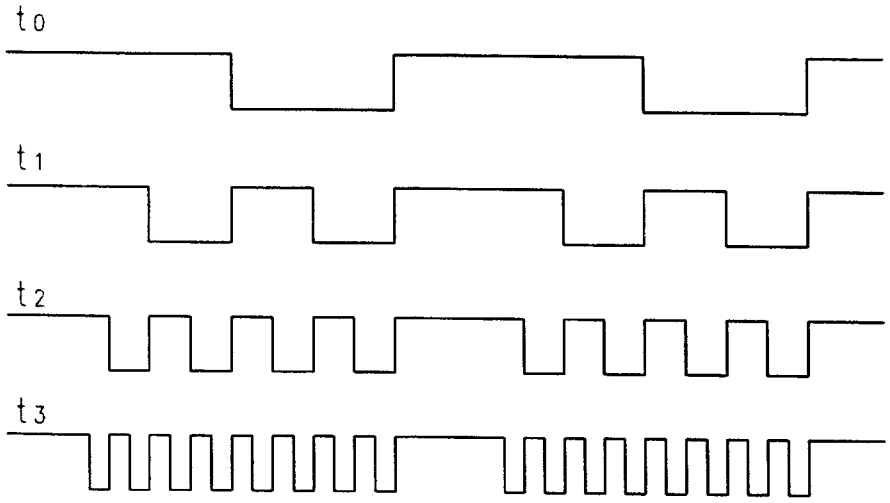
FIGS. 6A to 6D are timing diagrams illustrating input/output waveforms to/from a timing control part of FIG. 5.

As shown in FIG. 5, each timing control part 12 is comprised of a plurality of AND gates 500, an OR gate 510, which may be preset or reset, and a clocked buffer 520. The n timing signals $t_0$, $t_1$, $t_2$, . . . , $t_n$, which correspond to the number of bits, and the digital data input signals $b_0$, $b_1$, $b_2$, . . . , $b_n$ are respectively input to AND gates 500. The AND gates 500 perform a logical AND operation on the respective timing signals and data input signals. In the example shown in FIGS. 6A and 6B for four bits, the timing signals are $t_0$–$t_3$ as shown in FIG. 6A, and the data input signals are $b_0$–$b_3$. A logical OR operation is performed on the AND gate outputs.

The timing signal $t_0$, corresponding to a most significant bit $b_0$ among the digital data input signals, has the longest period, the timing signal $t_1$ corresponding to the bit $b_1$ has half the timing signal $t_0$ period, and the timing signal $t_2$ corresponding to the bit $b_2$ has a quarter of the timing signal to period. That is, I-th timing signal has the period $T_i$ as follows: $T_i=(½)^1\ T_0$.

Figure 6B:
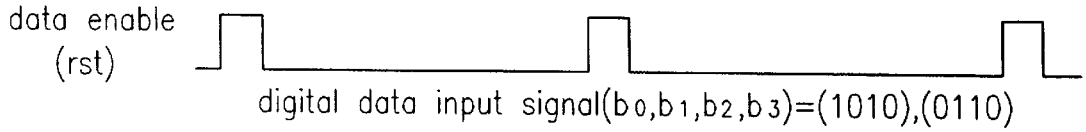
Figure 6C:
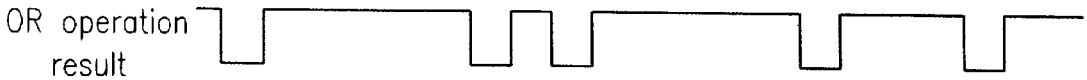
Figure 6D:
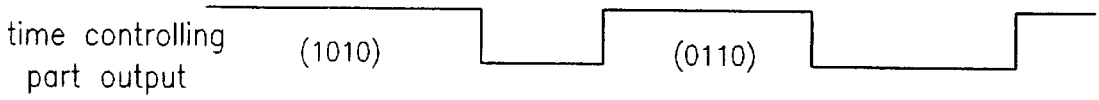

As shown in FIGS. 6B and 6D, when the data enable signal rst of the "H" level is input to a timing control part 12, the output signal of OR gate 510 is preset to the "H" level. Next, when the data enable signal rst of the "L" level is input, the output signal of OR gate 510 is controlled in accordance with the digital data signals from AND gates 500.

An output signal from the OR gate 510 is fed back to a reset input of the OR gate 510 through the clocked buffer 520.

When the output signal from the OR gate 510 becomes low, "L" level, as shown in FIG. 6C, the output signal is reset to halt the operation of the timing control part 12, keeping the output state of the timing control part 12 at the "L" level as shown in FIG. 6D. When the output of a timing control part 12 is high, the corresponding transistor 13 is on and ramp signal passes to light elements of a liquid crystal display.

When the data enable signal rst, as shown in FIG. 6B, is again input to the timing control part 12, the above operation is repeatedly performed. Accordingly, the output signal of the timing control part 12 is output as a pulse width modulated signal in accordance with the digital data input signal. The PWM output waveforms of the timing control part 12 in FIG. 6D show the cases of digital data input signals "1010" and "0110".

Figure 7:
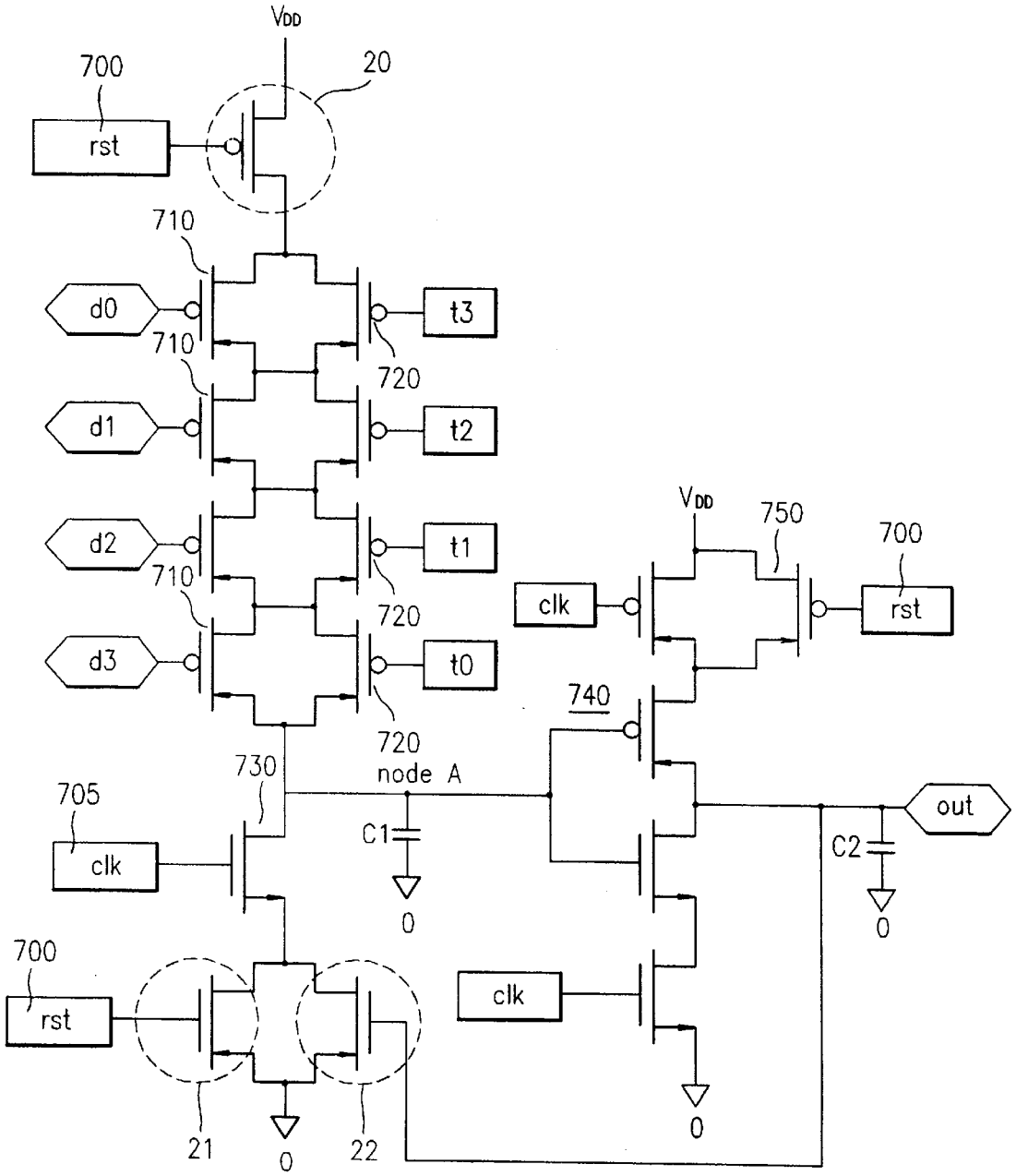
FIG. 7 is a circuit diagram of a timing control part of a data driver according to one embodiment of the present invention.

FIG. 7 is a circuit diagram of a timing control part of a data driver according to a second embodiment of the present invention. Referring to FIG. 7, parallel pairs of P-type transistors 710 and 720 constitute an AND gate and perform a logical ANDing operation, and the serial connection of each parallel pair of transistors 710 and 720 act as OR gates and perform a logical ORing operation. A final output signal is input to an N-type transistor 730 connected to the P-type transistor pairs 710 and serves to perform a reset function.

When the data enable signal rst 700 is applied, a first P-type transistor 20 is turned off, and a node A is connected from voltage $V_{DD}$. A first N-type transistor 21 is then turned on, and when the clock signal 705 goes to the "H" or high level to turn on transistor 730, the node A is connected to a ground voltage and is low. Meanwhile, when the data enable signal rst is changed to the "L" or low level, the timing signals $t_0$, $t_1$, $t_2$ and $t_3$ are applied to transistors 710 and a logical AND operation is performed. For the logical operation, the node A is precharged while the clock is held at the "H" or high level and the logical operation of input bits do, $d_1$, $d_2$ and $d_3$ the timing signals to, $t_1$, $t_2$ and $t_3$ is performed while the clock is kept at the "L" or low level, which result is output through an inverter 740. A p-type transistor 750 applies rst signal 700 to inverter 740.

While the output signal is kept at the "H" or high level, a second N-type transistor 22 is turned on and then a logical OR operation is performed, whereas when the output signal becomes low, "L" level, the second N-type transistor 22 is turned off and the node A remains at the "H" or high level. Therefore, until the next data enable signal rst 700 is applied, the output signal of the timing control part is held to the "L" or low level.

Figure 8:
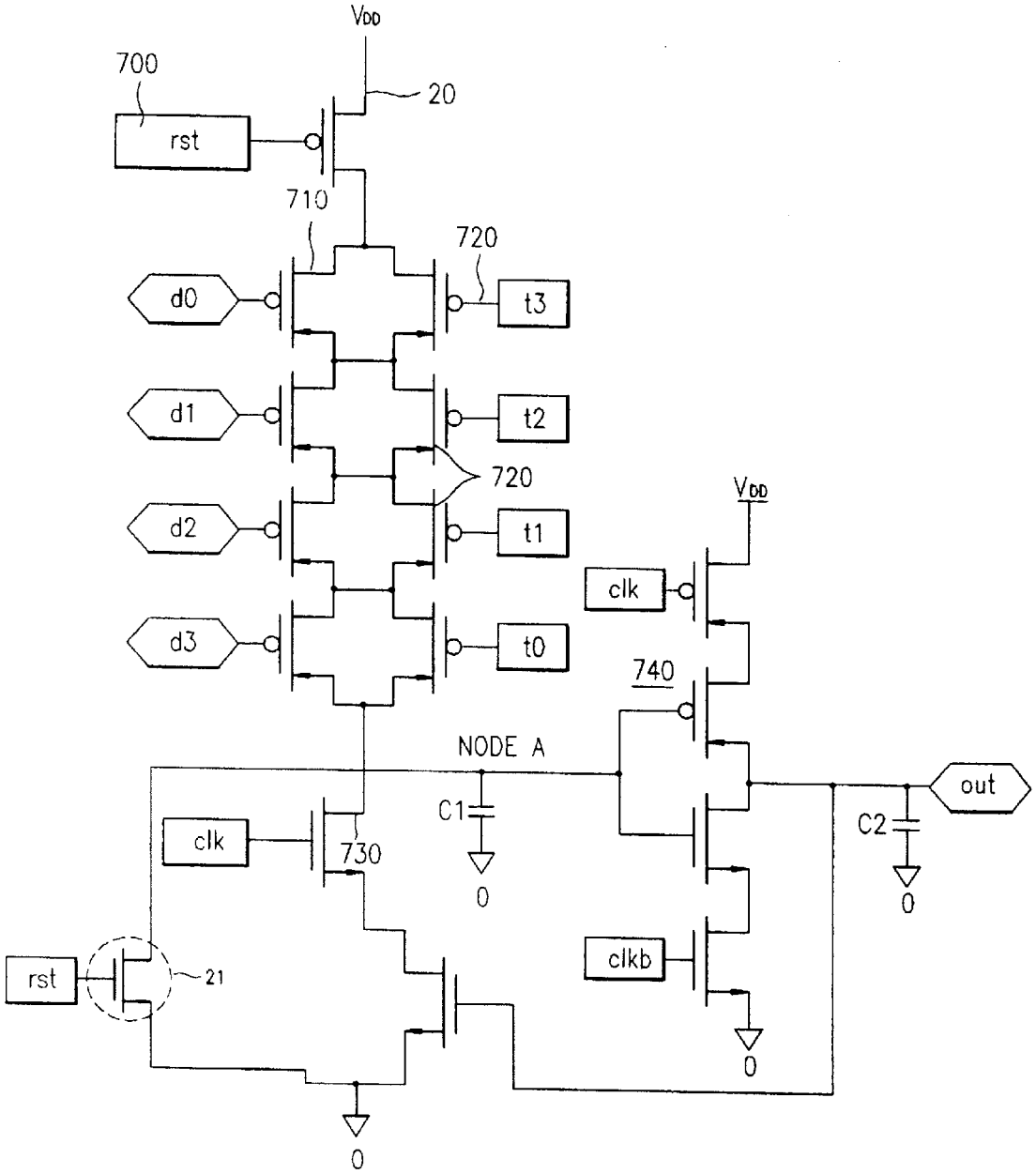
FIG. 8 is a circuit diagram of a timing control part of a data driver according to a second embodiment of the present invention.

FIG. 8 is a circuit diagram of a timing control part of a data driver according to a third embodiment of the present invention. In comparison to FIG. 7, the first N-type transistor 21 receiving the data enable signal rst 100 is directly connected to the node A, and the P-type transistor applying the data enable a signal rst to an inverter is not included, thereby making the discharge of the transistor faster and the circuit more stable.

Figure 9:
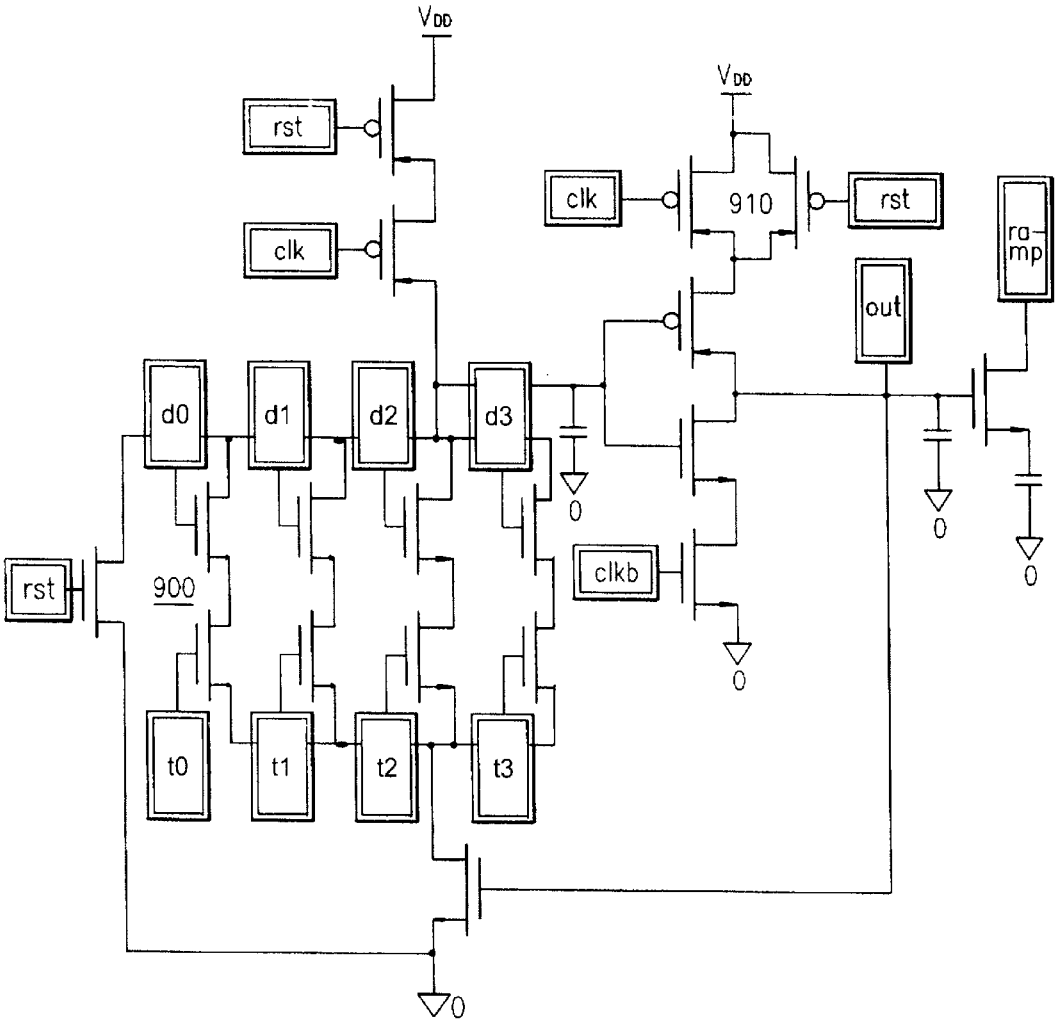
FIG. 9 is a circuit diagram of a timing control part of a data driver according to a third embodiment of the present invention.

FIG. 9 is a circuit diagram of a timing control part of a data driver according to a fourth embodiment of the present invention. A plurality of N-type transistor pairs 900 are connected in series to perform a logical ANDing operation, and a pair of N-type transistors 910 performs a logical ORing operation, being connected in parallel to each other.

As discussed above, a data driver for use in a liquid crystal display according to the present invention has advantages as follows: 1) a circuit construction can be simple, since the timing control parts, to which pulses are applied do not require a counter in each data line; and 2) a production yield of the liquid crystal display can be increased because of the simple data driver construction.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in th art to utilize the invention in various embodiments and with various modifications as are suited to the particular use contemplated. It is intended that the scope of the invention be defined by the claims appended hereto, and their equivalents.

What is claimed is:

1. A driving circuit for a liquid crystal display, comprising:

a plurality of data lines;

a sample and hold circuit connected to the data lines, for sampling and storing digital data of n bits from the data lines;

a timing control circuit for receiving the digital data and a plurality of timing signals, and performing a logical operation on the plurality of timing signals in accordance with the digital data; and a switching circuit for receiving a time varying signal and switching the time varying signal to a signal line of the liquid crystal display, wherein the switching time is controlled by the output of the timing control circuit.

2. The driving circuit according to claim 1, wherein the timing control circuit receives a plurality of timing signals of different period.

3. The driving circuit according to claim 2, wherein the plurality of timing signals includes a first timing signal and a second timing signal, and wherein the first timing signal has half the period of the second timing signal.

4. The driving circuit according to claim 1, wherein the time varying signal increases with time.

5. The driving circuit according to claim 4, wherein the time varying signal includes a ramp signal.

6. The driving circuit according to claim 1, wherein the number of the timing signals is equal to the number of bits of the digital data.

7. The driving circuit according to claim 1, wherein the timing control circuit includes a plurality of AND gates for receiving a corresponding timing signal and corresponding digital data to perform a logical ANDing operation, and an OR gate for receiving output signals from the plurality of AND gates to perform a logical ORing operation and for outputting the Ored result as an output.

8. The driving circuit according to claim 7, wherein the number of the AND gates is equal to the number of the plurality of timing signals.

9. The driving circuit according to claim 7, wherein the Ored output is fed back to the OR gate.

* * * * *